United States Patent [19]

Diesch et al.

[11] Patent Number: 4,460,814

[45] Date of Patent: Jul. 17, 1984

[54] OVEN ANTENNA PROBE FOR DISTRIBUTING ENERGY IN MICROWAVE

[75] Inventors: Bradford J. Diesch; Arnold M. Bucksbaum, both of Cedar Rapids, Iowa

[73] Assignee: Amana Refrigeration, Inc., Amana, Iowa

[21] Appl. No.: 425,118

[22] Filed: Sep. 27, 1982

[51] Int. Cl.[3] ..... H05B 6/72

[52] U.S. Cl. ..... 219/10.55 F; 219/10.55 R; 219/10.55 E; 99/419; 99/DIG. 14; 343/720; 343/873

[58] Field of Search ..... 219/10.55 R, 10.55 F, 219/10.55 A, 10.55 E, 10.55 M; 333/24, 245, 236; 343/703, 718, 720, 872, 873; 99/419, 451, DIG. 14; 426/243

[56] References Cited

U.S. PATENT DOCUMENTS

| | | | |
|---|---|---|---|
| 2,540,036 | 1/1951 | Spencer | 219/10.55 E |
| 2,576,862 | 11/1951 | Smith et al. | 219/10.55 A X |
| 2,646,511 | 7/1953 | Hulstede | 333/24 R |
| 3,092,514 | 6/1963 | Tomberlin | 219/10.55 A X |
| 3,980,855 | 9/1976 | Boudouris et al. | 219/10.55 A |
| 4,204,549 | 5/1980 | Paglione | 333/245 X |
| 4,221,948 | 9/1980 | Jean | 219/10.55 F X |
| 4,320,274 | 3/1982 | Dehn | 219/10.55 F X |
| 4,370,534 | 1/1983 | Brandon | 219/10.55 A |

*Primary Examiner*—Roy N. Envall, Jr.
*Assistant Examiner*—Philip H. Leung
*Attorney, Agent, or Firm*—Willaim R. Clark; Joseph D. Pannone

[57] ABSTRACT

Antenna for use with food product in a microwave oven, where one or more antennas are positioned into the food product for efficient and distributed heating of food product. The antenna includes a coaxial assembly of an inner conductor and an outer conductor with dielectric therebetween. A load end, configured as a probe, positions into the food product. A source end antenna element structure delivers power to the load end and subsequently to the food product. The structure at the source end may include a probe center conductor as well as gain antenna structures. The outer conductor may likewise be configured including ground plane disc, a folded-over coaxial outer conductor or the like.

4 Claims, 19 Drawing Figures

FIG. 2
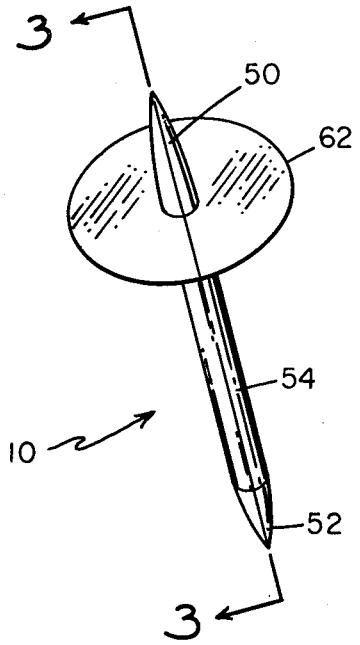
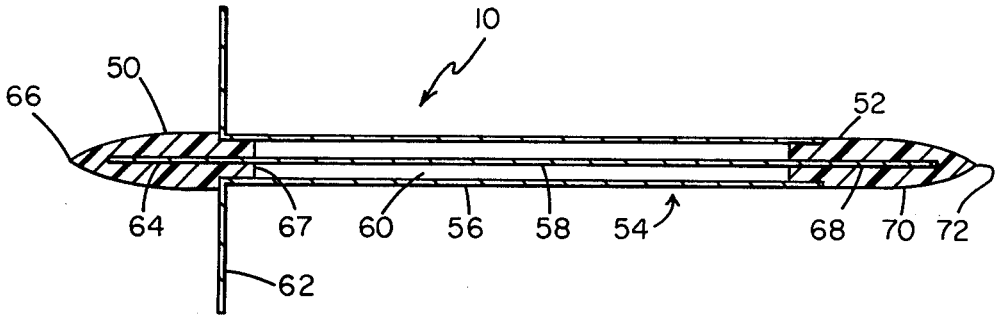
FIG. 3

OVEN ANTENNA PROBE FOR DISTRIBUTING ENERGY IN MICROWAVE

BACKGROUND OF THE INVENTION

1. Field of the Invention

The present invention pertains to a microwave oven and, more particularly, pertains to an antenna for positioning in food product within the cavity for efficient and distributed heating by reradiating microwave energy.

2. Description of the Prior Art

The prior art has not provided an antenna for insertion into the food product during heating in a microwave cavity by microwave energy.

The prior art has utilized numerous methods for evenly heating food product in a microwave oven cavity by microwave energy. Some of these methods have included rotating a mode stirrer enhancing the electromagnetic wave propogation through the various TE and TM modes, rotating of the food product within the food cavity either manually or through an electric motor configuration, utilizing microwave absorbing ferrite members on cookware, and utilizing more than one source of microwave energy feed into the oven cavity.

One of the problems with the prior art methods is that the particular type of heating enhancement process was limited to that particular type of oven. The principles such as a rotating carrousel or microwave absorbing cookware were not always applicable to other types of microwave ovens made by other manufacturers. Manufacturers have constructed their ovens such that certain heat enhancing processes or products will work in a particular oven as defined by a certain physical structure.

In microwave heating of food product, also referred to as microwave cooking, it has long been recognized that food cooks from the outside in. Depending upon the size, shape, consistency and bulk of food product, it sometimes occurs that the energy is not evenly distributed, thereby causing hot spots or possibly spots that are not cooked. This has been in part due to the prior art process of subjecting the food product to microwave energy only from the outside. Many times, the outside of the food product may cook faster and appear done before the inside is fully cooked.

Another problem of the prior art microwave ovens has been that it has been impossible to cook a food product within a metal container. The reason for this is that the metal container effectively shields the electromagnetic radiation from reaching the product. Even the top of an uncovered metal container may act as a trap and prohibit the electromagnetic radiation from traveling any distance below the immediate surface area of the product within the container.

The present invention overcomes the problems of the prior art by providing an antenna-like structure including a source end, a load end, and a coaxial line therebetween the reradiating energy from a microwave oven cavity directly into food product for more even and distributed heating of the food product.

SUMMARY OF THE INVENTION

The general purpose of the present invention is to provide an antenna-like structure for reradiating microwave energy into food product. The antenna-like structure including a source end and a load end with transmission line therebetween receives electromagnetic energy at the source end and couples this energy to a load end through a transmission line. The load end is positioned in the food product. The load end of the antenna-like structure can assume any geometrical configuration of known or the like antenna element structures for reradiating electromagnetic energy from a source adjacent to and in proximity with the food product.

According to one embodiment of the present invention, there is provided a reradiating structure for use in a microwave oven cavity or like microwave environment for reradiating energy from free space into a product such as food. The reradiating structure includes a source end having at least one element, a transmission line connected to the source end, and a load end having at least one element whereby the load end is inserted and positioned within a food product. The source end positions in free space, thereby coupling the electromagnetic energy from the source end through the transmission line to the load end for subsequent reradiation at that point in the food product. This provides for more efficient and distributed energy coupling for heating the food product. The source end may include in its most elementary form a ground plane or coaxial configuration of antenna structure while the load end may include a probe-like element connected to the center conductor. The outer conductor of the transmission line may contact the food product.

According to another embodiment of the present invention, there is provided a reradiating structure for use in a microwave oven cavity or like microwave environment for reradiating energy from a waveguide into a product such as food. The reradiating structure includes a source end having at least one element positioned on a coaxial plug, a transmission line connected to the source end, and a load end having at least one reradiating element. The load end is inserted into a food product, and the source end is plugged into a jack in a waveguide of a microwave oven, thereby coupling the electromagnetic energy from the source end through the transmission line to the load end for subsequent reradiation into the food product.

One significant aspect and feature of the present invention is a reradiating structure being antenna-like in having both a source end and a load end which is applicable for use in all types of microwave ovens of all manufacturers as well as near any microwave sources. The structures may be used in the domestic environment such as the cooking of foods in a microwave oven cavity or in the industrial environment such as the curing, heating or drying of products. The principles of operation of the present invention are applicable to all types of microwave heating, and the specific examples illustrated in the drawings are by way of illustration only and are not to be construed as limiting of the principles and teaching of the present invention.

The reradiating antenna-like structures may be utilized individually or inserted in groups into a product, or several of the antenna-like structures may be positioned throughout an oven cavity or an electromagnetic energy environment for reradiating energy towards the food product.

Another significant aspect and feature of the present invention is a microwave antenna for use in a microwave oven cavity for insertion into food product for reradiating energy within the cavity directly into the food product through the antenna-like structure. The reradiating antenna-like structure includes a source end having at least one receiving element for receiving energy, a transmission line coupled to the source end, and a load end at the other end of the transmission line for propagating the received energy directly into the food product. The source end may include a ground plane-like configuration, a coaxial-like configuration, or any directive element or array configuration. The load end resembles a probe for easy insertion into the food product. The outer conductor of the transmission line may directly contact the food product. The reradiating antenna-like structure leaves a small hole in the food product similar to the type of a hole left by a probe in a piece of meat.

A further significant aspect and feature of the present invention is a reradiating antenna-like structure for coupling energy from an adjacent microwave source to the center of a food product for efficient and distributed heating by microwave energy. The reradiating antenna-like structure provides for coupling of energy directly to the center of the food product, providing for more efficient cooking as well as reduced cooking time.

An additional significant aspect and feature of the present invention is a reradiating microwave antenna structure for retransmitting of energy from within the oven cavity to within the food product. This is particularly useful when the food product is located within a metal container such as a can of soup or the like.

Having thus described one embodiment of the present invention, it is the principal object hereof to provide a reradiating microwave antenna-like structure for enhancing efficient and evenly distributed microwave heating of a food product in a microwave oven cavity.

One object of the present invention is to provide a microwave reradiating antenna-like structure for insertion in a probe-like manner into a food product and including a small antenna-like source load protruding above and beyond the food product for receiving microwave energy from an adjacent microwave source in the microwave cavity and coupling this energy through a transmission line to the load end which is inserted into the food product.

Another object of the present invention is to provide a microwave reradiating antenna-like structure which is applicable in usage to any available microwave oven cavity sold in the consumer marketplace. While the antenna-like structure is intended for home domestic use, the principles as well as the teachings of the present invention are as applicable to industrial use.

A further object of the present invention is to provide a microwave reradiating antenna-like structure for use in a microwave oven cavity which can be used individually as a sole reradiating and coupling structure or can be used in groups for larger food products such as turkeys, chickens, roasts or the like.

An additional object of the present invention is to provide a microwave reradiating antenna-like structure for receiving microwave energy within a microwave cavity and retransmitting the received microwave energy to a second point, the second point being in a food product. The food product may be in any type of container made of glass, ceramic, metal or the like. The microwave transparency of the container does not make a difference. The energy is retransmitted as received by a source end, coupled through a transmission line, and retransmitted by a load end. The load end may be positioned in food product.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures and wherein:

FIG. 2 illustrates a perspective view of the antenna of FIG. 1;

FIG. 3 illustrates a view taken along line 3—3 of FIG. 2;

DESCRIPTION OF THE PREFERRED EMBODIMENTS

Figure 1:
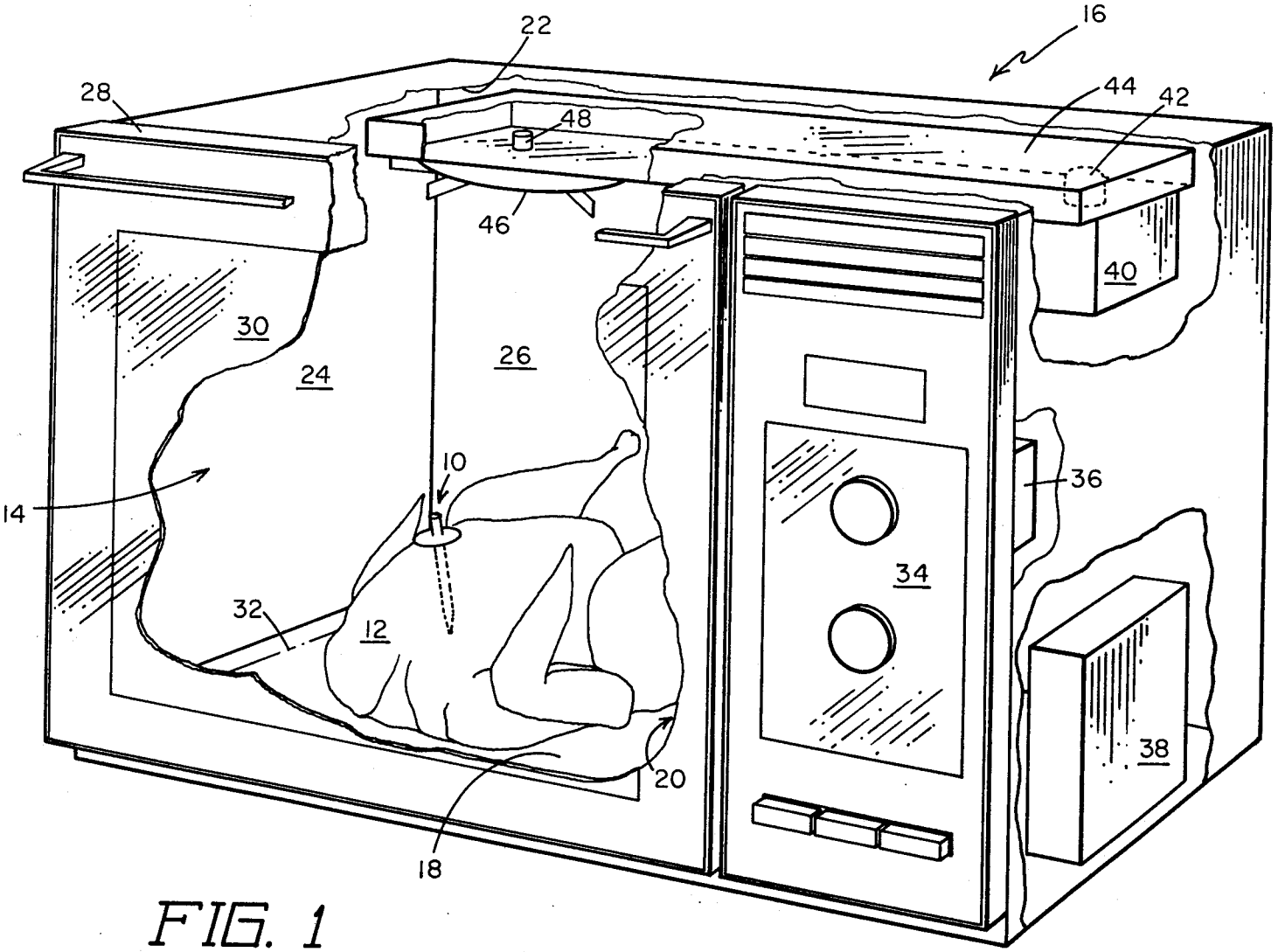
FIG. 1 illustrates an elevated perspective view of a microwave oven partially cut away showing a microwave reradiating antenna-like structure in a food product in a microwave oven cavity environment.

FIG. 1 illustrates a microwave reradiating antenna-like structure 10 positioned in a food product 12 in a microwave oven cavity 14 of a microwave oven 16. The microwave oven cavity 14 includes five sides 18, 20, 22, 24, and 26 and a door 28. The door 28 includes a see-through window 30 as known in the art. The food product 12 can be a piece of poultry, meat or the like positioned on a glass cooking plate 32. A control panel 34 supports a plurality of touchable, programmable controls connected to a microprocessor and/or electromechanical control circuit 36 for regulating a microwave oven power supply 38 for powering the magnetron 40. The magnetron 40 includes a probe antenna 42 coupled into a waveguide 44 which connects to the cavity 14. An antenna 46 is positioned and coupled to the waveguide 44 by a probe 48 for distributing energy from the waveguide, but in a like manner, a mode stirrer can be utilized for direct distributing of the energy from the waveguide as known in the art.

FIG. 2 illustrates a perspective view of the reradiating microwave antenna-like structure 10 including a source end 50, a load end 52, and a coaxial transmission line 54. A copper ground plane-like disc 62 substantially encompasses the lower portion of the source end 50. The disc 62 may be any electrically conductive material.

FIG. 3 illustrates a sectional view taken along line 3—3 of FIG. 2 showing the source end 50, the load end 52, the coaxial transmission line 54 including an outer conductor 56, an inner conductor 58, and an air or like dielectric 60 therebetween. Air is the dielectric in this instance. The inner conductor 58 connects to a probe-like element 64. The ground disc 62 connects to the outer conductor 56. A probe-shaped dielectric 66 extends over the element 64 about the disc 62 and slightly into the outer conductor 56 of the coaxial transmission line 54. A probe element 68 is provided at the load end 52 and likewise includes a polypropylene or polyethylene dielectric 70 shaped as a probe for insertion into the food product. The polypropylene dielectric 70 is provided with a point 72 to ease insertion into the food product such as meat, poultry or the like. The coaxial transmission line conductors 56 and 58 can be made from stainless steel, copper or the like for transmission of electrical energy as well as for direct electrical connection and communication of the outer conductor 56 with the food product 12. The dielectric may also be a suitable plastic or like dielectric material.

Figure 4:
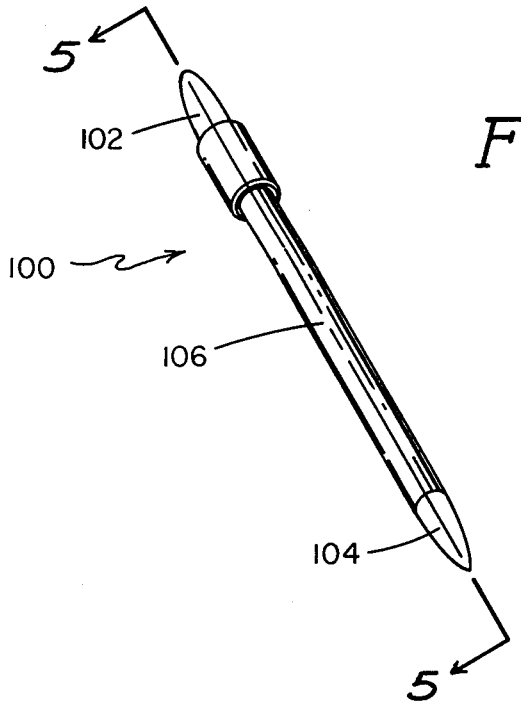
FIG. 4 illustrates a perspective view of a coaxial microwave reradiating antenna-like structure.

FIG. 4 illustrates a perspective view of a coaxial microwave reradiating antenna-like structure 100 including a source end 102, a load end 104, and a coaxial transmission line 106.

Figure 5:
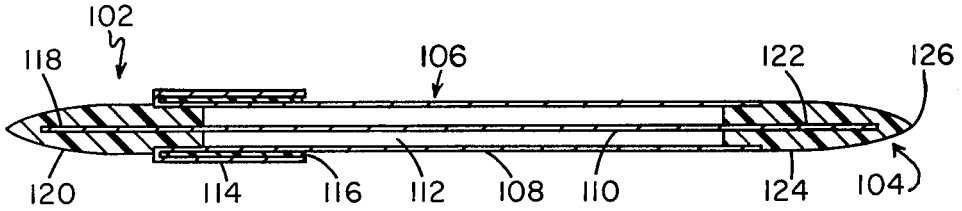
FIG. 5 illustrates a view taken along line 5—5 of FIG. 4.

FIG. 5 illustrates a sectional view taken along line 5—5 of FIG. 4 showing the source end 102, load end 104 and coaxial transmission line 106. The coaxial transmission line 106 includes an outer conductor 108, an inner conductor 110, and an air or the like dielectric 112. A coaxial section 114 folds over about the source end 102 of the outer conductor 108. Polypropylene or like dielectric sealant 116 fills the void at the fold-over. A probe source element 118 connects to the inner conductor 110. Polypropylene or the like 120 surrounds the element 118 and a portion of the inner conductor 110. A load element 122 connects to the inner conductor 110. Polypropylene or the like dielectric 124 is fashioned to a point 126 about the load element 122 providing for insertion of the load end 104 into the food product.

Figure 6:
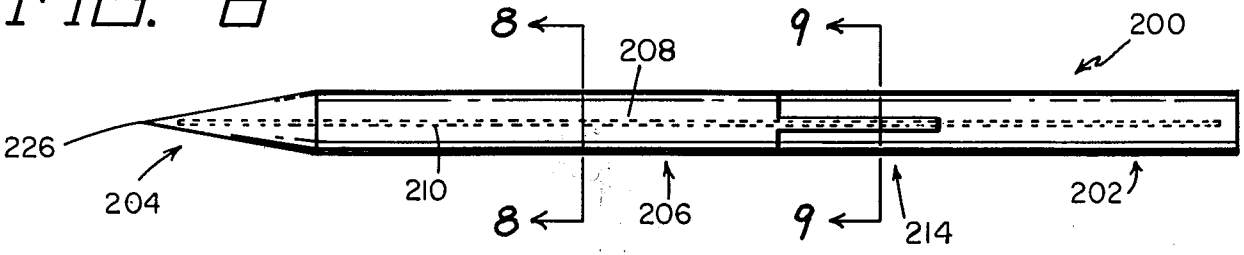
FIG. 6 illustrates a top view of a J-pole microwave reradiating antenna-like structure.
Figure 7:
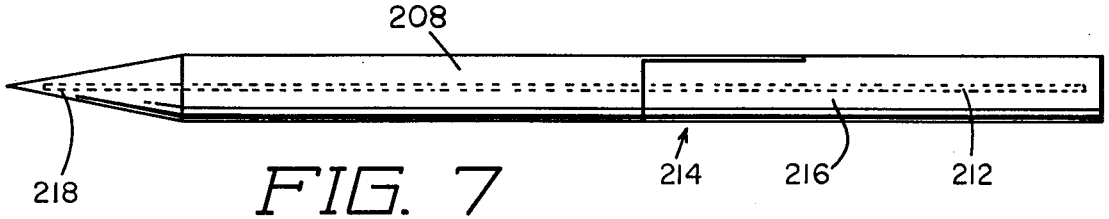
FIG. 7 illustrates a side view of FIG. 6.
Figure 8:
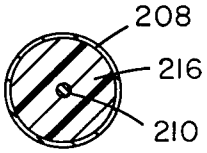
FIG. 8 illustrates an enlarged sectional view taken along line 8—8 of FIG. 6.

FIG. 6 illustrates a top view of a stripline microwave reradiating antenna-like structure 200 including a source end 202 which positions in free space, a load end 204 which positions in the food product, and a coaxial transmission line 206 including an outer conductor 208 and an inner conductor 210 as illustrated in FIG. 8, which connects the source end 202 positioned above the food product and the load end 204 substantially positioned within the food product. As illustrated in FIG. 7 and FIG. 8 in combination with FIG. 6, the antenna 200 includes a receiving antenna 212 at source end 202, an impedance matching section 214, a transmission line 206 such as the coaxial inner conductor 210, outer conductor 208 and dielectric 216 disposed therebetween, whether the dielectric be air or polyethylene structure, and a transmitting antenna 218 at the load end 204. The load end 204 includes a pointed probe-like section 226.

Figure 9:
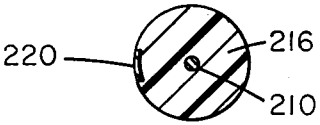
FIG. 9 illustrates an enlarged sectional view taken along line 9—9 of FIG. 6.

FIG. 6 and FIG. 7 together with FIG. 9 illustrate the source end 202 and receiving antenna 212, the impedance matching section 214, the transmission line 206, and the load end 204 and transmitting antenna 218. The inner conductor 210 and outer conductor 208 are in a "J" antenna configuration including the "J" section 220. The antenna structure 200 lends itself to microstripline configuration.

FIG. 8 illustrates an enlarged sectional view taken along line 8—8 of FIG. 6 where all numerals correspond to those elements previously described. The coaxial dielectric can be foam, polyethylene, plastic, or like dielectric material in the coaxial transmission line 206. The circular cross section of the antenna is noted in the figure.

FIG. 9 illustrates an enlarged sectional view taken along line 9—9 of FIG. 6 where all numerals correspond to those elements previously described and particularly illustrating the J element 220.

Figure 11:
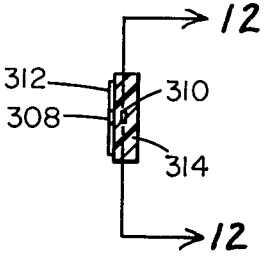
FIG. 11 illustrates a sectional view taken along line 11—11 of FIG. 10.
Figure 10:
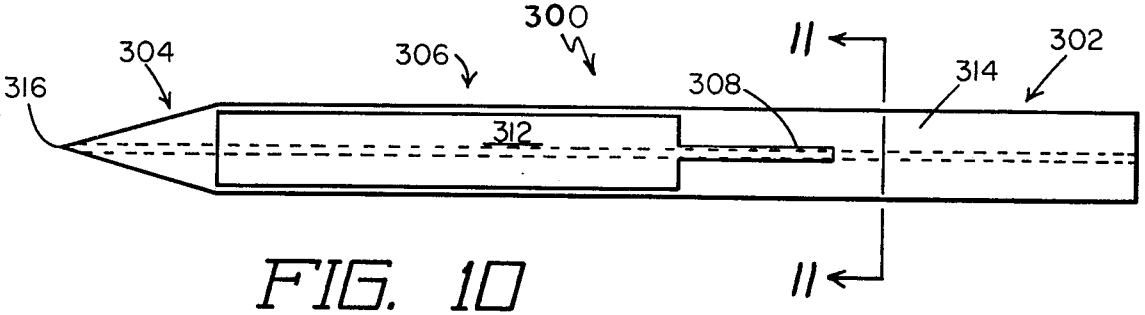
FIG. 10 illustrates a top view of a stripline microwave reradiating antenna-like structure.
Figure 12:
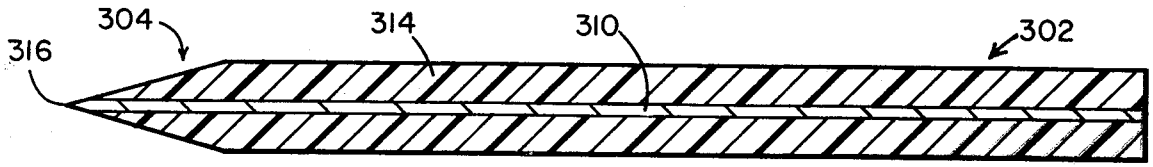
FIG. 12 illustrates a sectional view taken along line 12—12 of FIG. 11.

FIG. 10, FIG. 11, and FIG. 12, illustrate a stripline microwave reradiating antenna-like structure 300 including a source end 302, a load end section 304, a transmission line section 306, and impedance matching J section 308. An inner conductor 310 extends from the source end 302 to the load end 304. An outer conductor 312 runs along the top side of the section 306 and connects to the J section 308 as illustrated in FIG. 11. The striplines 310, 312 and 308 are deposited and supported on a dielectric material 314. The load end 304 is fashioned as a probe 316 for inserting into food product.

Figure 13:
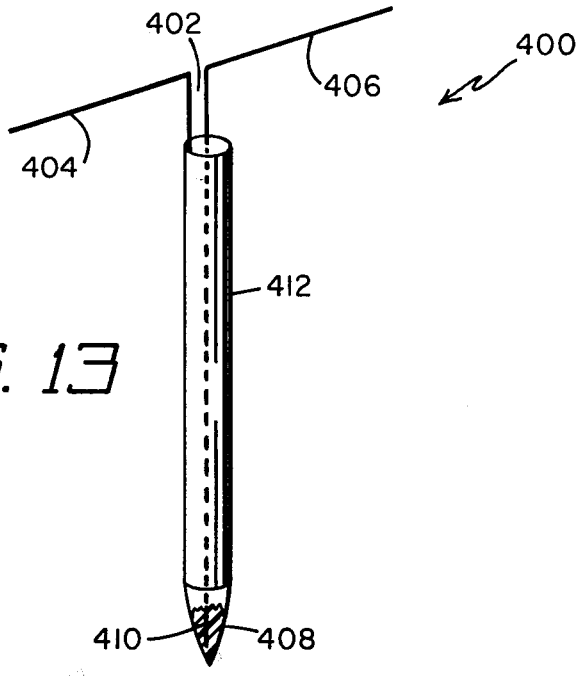
FIG. 13 illustrates a perspective view of a dipole of a microwave reradiating antenna-like structure.

FIG. 13 illustrates a perspective view of a dipole microwave reradiating antenna-like structure 400, including a source end 402 of two quarter wave elements 404 and 406, a load end 408 with an element 410 for positioning in food product and a coaxial transmission line 412 which can include a dielectric.

Figure 14:
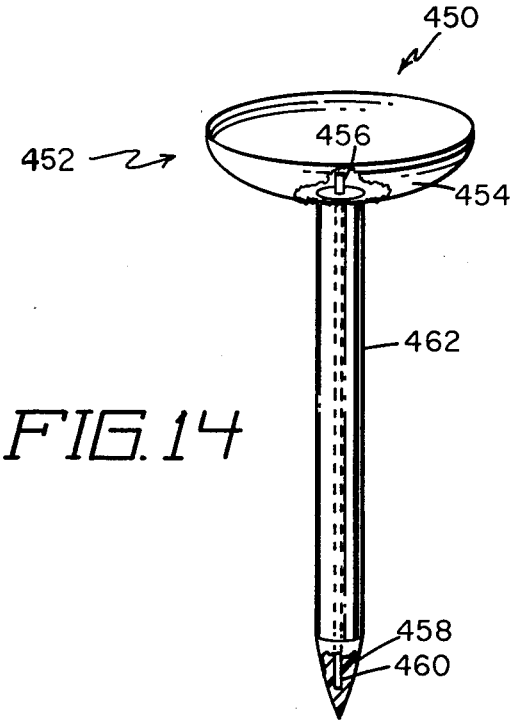
FIG. 14 illustrates a perspective view of a parabolic microwave reradiating antenna-like structure.

FIG. 14 illustrates a perspective view of a parabola microwave antenna reradiating antenna-like structure 450 including a source end 452, with a parabolic reflector 454 and feed 456, a load end 458 with an element 460 and a transmission line 462 which can include a dielectric.

Figure 15:
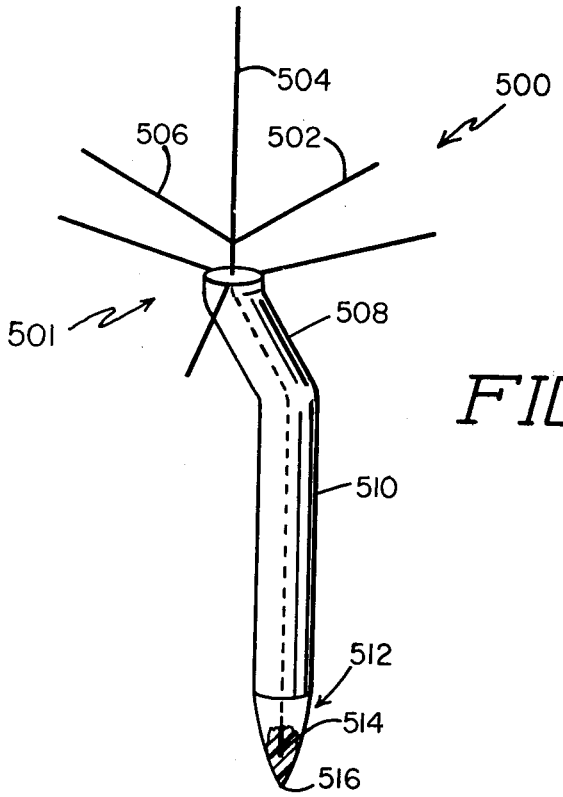
FIG. 15 illustrates a perspective view of a three-dimensional phased array microwave reradiating antenna-like structure.

FIG. 15 illustrates a perspective view of a three-quadrant array of microwave reradiating antenna-like structure 500 including a source end 501 with dipole elements 502, 504, and 506 orthogonally arranged and coupled serially in order to an impedance-matching section 508, a transmission line section 510, and a load end 512 including an element 514 at a probe-like end 516 of plastic or the like.

Figure 16:
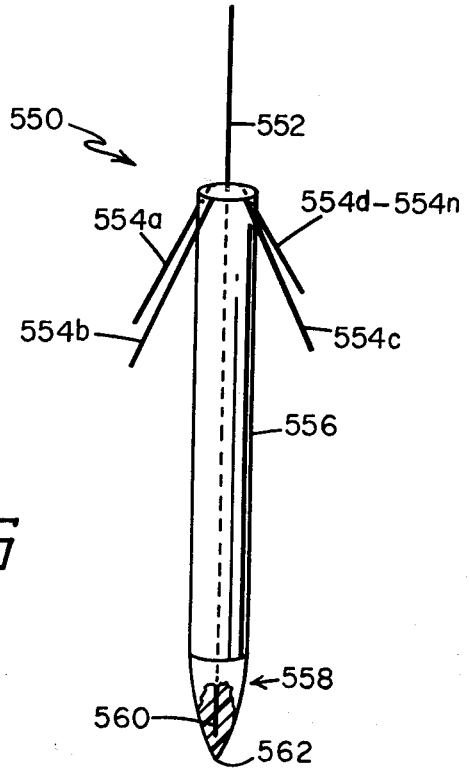
FIG. 16 illustrates a perspective view of a ground plane microwave reradiating antenna-like structure.

FIG. 16 illustrates a perspective view of a ground plane microwave reradiating antenna-like structure 550 including an element 552, a plurality of ground plane radials 554*a*–554*n*, transmission line 556, and a load end 558 which substantially positions in the food product including a radiating element 560 in a probe configured end 562.

Figure 17:
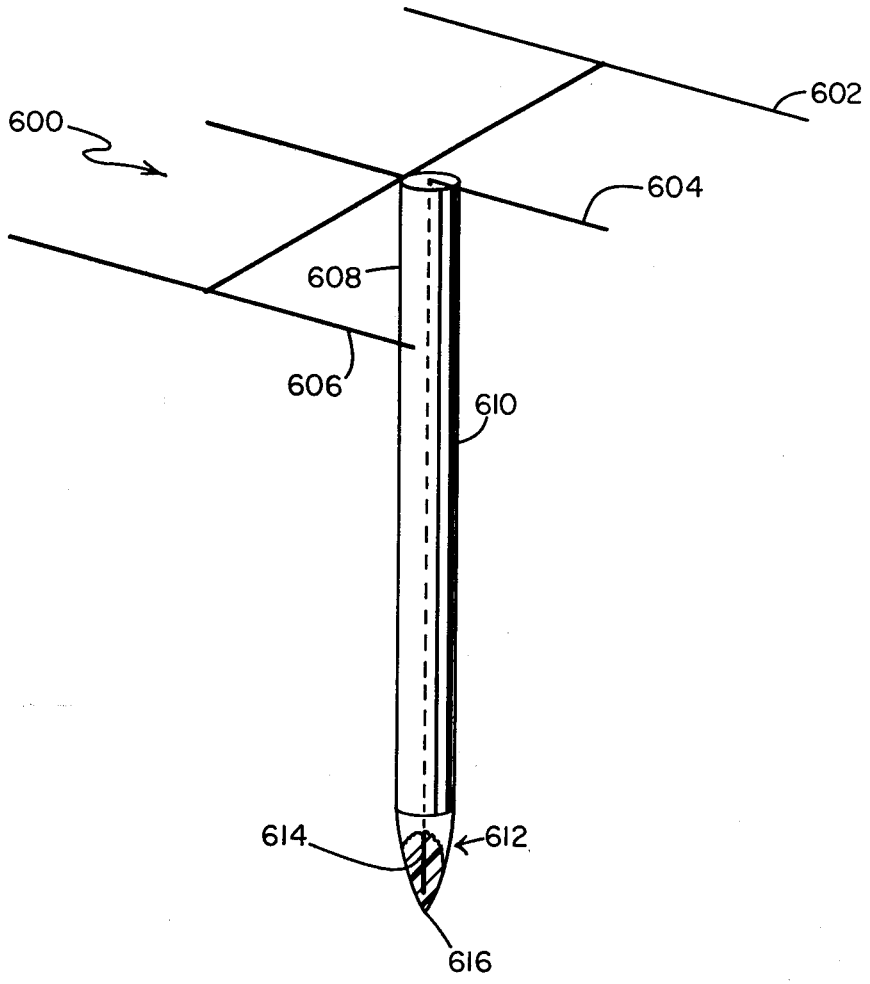
FIG. 17 illustrates a perspective view of a directional array microwave reradiating antenna-like structure.

FIG. 17 illustrates a perspective view of a three-element directional array 600 including a director 602, a driven element 604, reflector element 606, a matching section 608, a transmission line section 610, and a load section 612 which substantially positions within the food product. The directional array can be three elements or any number of elements either greater or lesser in number, by way of example and for purposes of illustration only and not to be construed as limiting of the present invention. The antenna 600 includes the radiating element 614 in a plastic probe configured end 616.

Figure 18:
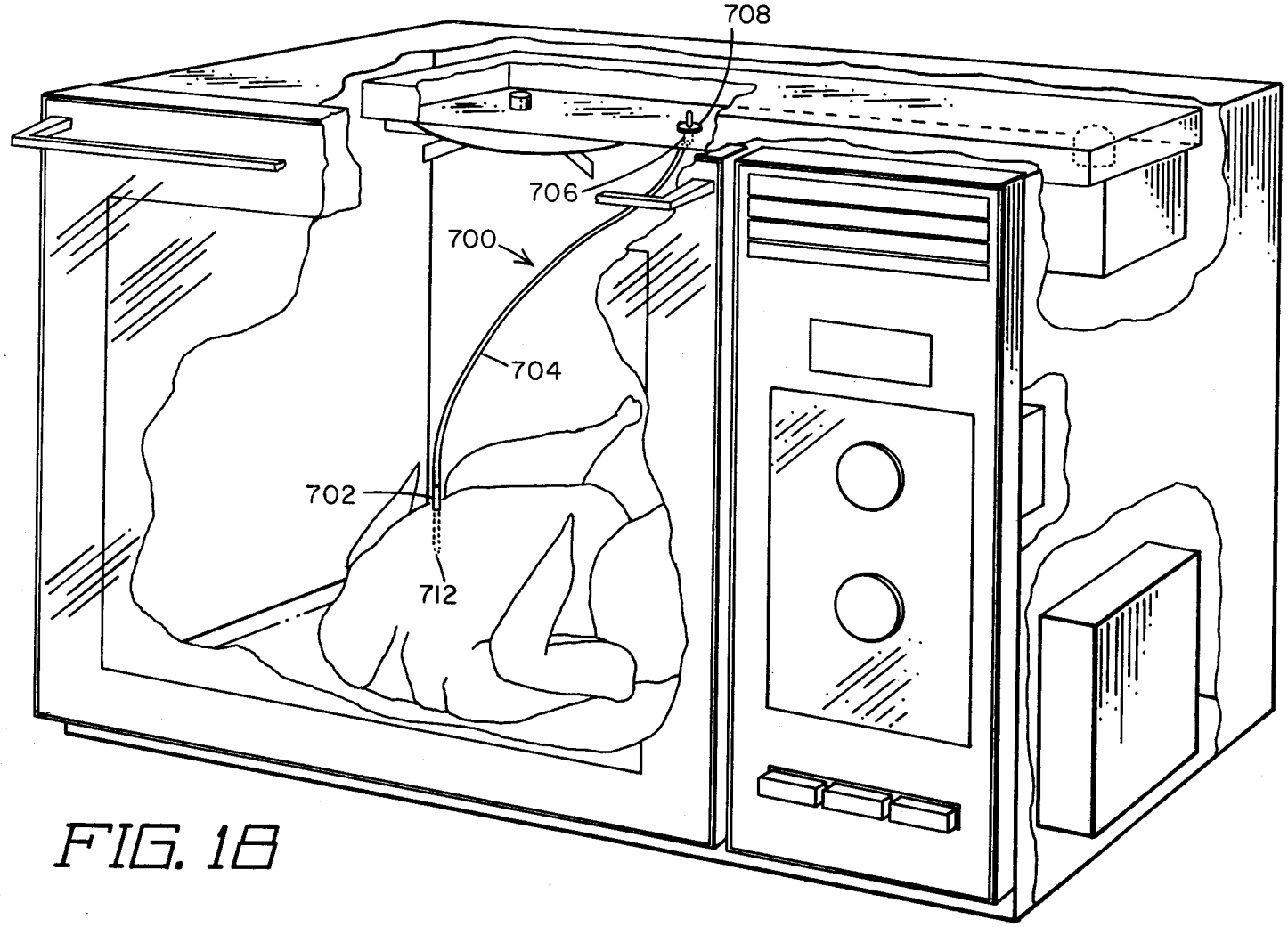
FIG. 18 illustrates a perspective view of an additional embodiment of the present invention of a microwave reradiating antenna-like structure including a coaxial transmission line with a plug for plugging into a waveguide feeding a microwave oven cavity of the microwave oven; and, FIG. 19 illustrates the probe transmission line-plug assembly.

FIG. 18 illustrates a perspective view of a microwave oven with a microwave reradiating antenna-like structure 700 including a load-end probe 702, a flexible transmission line 704, and a source end probe plug 706, as now described in detail. The microwave oven is identical to that described for FIG. 1, with the exception of an additional element, that is, a female jack 708 for accepting a male plug 706. The female jack is less than a fractional wavelength so as to allow energy passing through the waveguide to reradiate when the plug is not in position but is of such a diameter as to accomodate a probe-like cylindrical member as known in the electrical art and as further illustrated in FIG. 19. The load end 702 includes a radiating probe 710 and a configured end of dielectric material such as plastic or the like 712 having a pointed probe configuration. The load end can be a section of transmission line as previously described providing for the probe 710 to protrude into the food product in the cavity as illustrated. The transmission line 704 can be flexible or rigid, and preferably would be coaxial including an inner conductor 714, an outer conductor 716, a dielectric 718 as known in the art. While the load end 702 can be bare electrically conductive metal, the load end can also include a covering. The load end might also inherently include a matching section or be designed electrically and inherently as a matching section to the transmission line. Basically, though, the load end 702 includes a bare metal conductor 722 connecting to the outer conductor 716 of the coaxial cable, and an inner conductor 724 with a dielectric 726 therebetween. The outer conductor 722 can be either electrically conductive metal or can include a dielectric covering and which may require that the section 702 be impedance matched. The plug 706 is a standard electrical plug connecting the outer conductor of the coaxial shield to a metal portion 728 which engages electrically with a rim 730 of the jack 706. The probe element 732 connects to the inner conductor 714 and extends thereabove a fraction of a wavelength. Inherently, the element 732 is insulated from the ground potential member 728.

Figure 19:
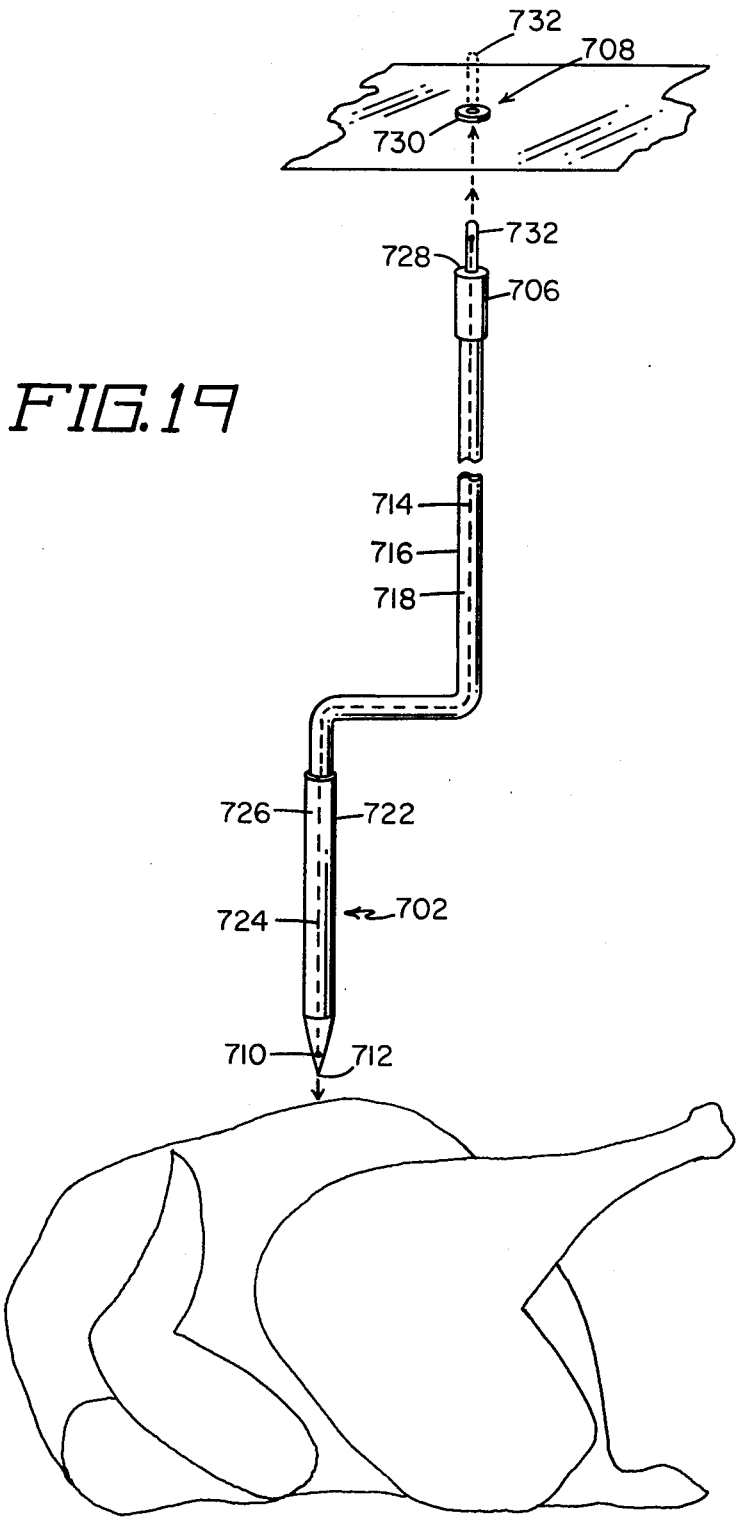

FIG. 19 illustrates a plan view of the probe transmission line-plug assembly, where all numerals correspond to those elements previously described. The transmission line can be flexible, semirigid, or rigid, but in all likelihood would be flexible such as RG-8/U or RG-174/U.

MODE OF OPERATION

As illustrated in FIG. 1, FIG. 2 and FIG. 3, the antenna 10 is utilized in a probe-like manner by inserting the load end 52 into the food product 12 with the source end 50 extending into the microwave field. The source end 50 including the probe element 64 receives and couples energy through the coaxial transmission line 54 for reradiating from the element 68 in the center or like area of the food product 12. This reradiating of microwave energy and the transverse electric and transverse magnetic modes provides for efficient distribution of energy through the food product 12.

The antenna 10 operates in conjunction with energy radiating from the waveguide in that the food product not only absorbs electromagnetic energy transmitted through the waveguide but also absorbs electromagnetic energy reradiating through the antenna from the source end 50, down through the transmission line 54, and to the load end 52 positioned in the food product. The heating of a food product therefore is through a two-fold process. The first is through direct reception of electromagnetic energy, and the second is through reradiation of the electromagnetic energy coupled directly into the food product.

While the specific antenna 10 is illustrated as having a bare metal electrically conductive outer transmission line which comes directly in contact with the food, this portion of the transmission line may be covered with a dielectric such as plastic and an impedance matching section may be required to match a specific antenna to a specific food product. Generally, though, the outer conductor or conductors of the transmission line would be bare and in contact with the food product.

The operation of the antenna of FIGS. 4 and 5 is identical to that described for antenna 10. Likewise, the operation of the antennas illustrated in FIGS. 6–17 is identical in principle and operation.

FIG. 18 illustrates the same principles of the invention, that is, two-fold heating of a food product with energy by radiation of electromagnetic energy through the waveguide as well as being coupled by hard wire from the waveguide directly into the product. The source end element 732 positions in the waveguide proper while the load end 702 positions in the food product with a transmission line 704 running therebetween.

The length of the probe elements, as well as the ground plane disc or folded-over coaxial section may be at least one-quarter wavelength or some multiple such as five-eighths or any other multiple thereof. The length of transmission line conductor whether the transmission line be coaxial or stripline is at least one-half wavelength or some multiple thereof. The finite physical length is dependent, of course, upon the frequency of operation of the microwave energy source.

Various modifications may be made to the present invention without departing from the scope thereof. The various source end antenna elements may be a plurality of directional elements or a plurality of omnidirectional elements providing for received gain. It is envisioned that possibly two or more reradiating antenna-like structures may be utilized for large food products. The transmission lines may be coaxial cable, stripline, or the like, preferably as long as the outer conductors or one of the conductors touches and, in effect, grounds with the food product.

While it has been illustrated that the antennas are positioned in the food product, the antennas may also be positioned within the cavity for reradiating energy to different locations of the oven.

What is claimed is:

1. A device for receiving, transmitting and re-radiating microwave energy from the cavity of a microwave oven into the interior of a food body positioned therein, comprising:

a rigid coaxial transmission line having an inner conductor and an outer conductor having first and second ends;

a radiating antenna comprising a probe of said inner conductor extending beyond said first end of said outer conductor, said radiating antenna probe being encased in a dielectric material having a point for inserting said radiating antenna into said food body; and a receiving antenna comprising a probe of said inner conductor extending beyond said second end of said outer conductor and a ground plane defined by a disk connected perpendicularly to said second end of said outer conductor wherein a portion of said microwave energy radiated into said cavity is received by said receiving antenna, is transmitted along said rigid coaxial transmission line, and is re-radiated from said radiating antenna to the interior of said food body.

2. The device recited in claim 1 wherein said dielectric material is plastic.

3. The device recited in claim 1 wherein said inner conductor probes extending from said first and second ends of said outer conductor are at least one-quarter wavelength.

4. The device recited in claim 1 wherein said disk has a radius of at least one-quarter wavelength.

* * * * *